US007167190B2

(12) United States Patent
Ito et al.

(10) Patent No.: US 7,167,190 B2
(45) Date of Patent: Jan. 23, 2007

(54) METHOD OF DRIVING ELECTRO-OPTICAL APPARATUS, DRIVE CIRCUIT FOR ELECTRO-OPTICAL APPARATUS, ELECTRO-OPTICAL APPARATUS, AND ELECTRONIC APPARATUS

(75) Inventors: Akihiko Ito, Nagano-ken (JP); Akira Inoue, Shiojiri (JP); Yutaka Ozawa, Nagano-ken (JP); Ryo Ishii, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 102 days.

(21) Appl. No.: 09/944,189

(22) Filed: Sep. 4, 2001

(65) Prior Publication Data

US 2002/0036610 A1 Mar. 28, 2002

(30) Foreign Application Priority Data

Sep. 8, 2000 (JP) ..... 2000-273147

(51) Int. Cl.
*G09G 5/10* (2006.01)

(52) U.S. Cl. ..... 345/690; 345/89; 345/211; 315/169.1; 315/169.2; 315/169.3; 315/169.4

(58) Field of Classification Search ..... 345/89, 345/589, 690–692, 50–54, 55, 60, 63, 77, 345/98–100, 92, 96; 315/169.1–169.4
See application file for complete search history.

(56) References Cited

U.S. PATENT DOCUMENTS 5,818,419 A * 10/1998 Tajima et al. ..... 345/691
6,127,991 A * 10/2000 Uehara et al. ..... 345/60
6,317,104 B1 * 11/2001 Kasahara et al. ..... 345/63
6,806,859 B1 * 10/2004 Kanoh et al. ..... 345/98

FOREIGN PATENT DOCUMENTS

| | | |
|---|---|---|
| JP | A-61-005295 | 1/1986 |
| JP | A-63-107381 | 5/1988 |
| JP | A-07-072825 | 3/1995 |
| JP | B-07-060300 | 6/1995 |
| JP | A-09-006287 | 1/1997 |
| JP | A-11-352929 | 12/1999 |

* cited by examiner

*Primary Examiner*—Henry N. Tran
(74) *Attorney, Agent, or Firm*—Oliff & Berridge, PLC

(57) ABSTRACT

The invention reduces power consumption when, for example, a mobile personal computer is in a power-saving mode or when a cellular phone is in a wait mode, in an electro-optical apparatus, such as a liquid crystal display of the subfield drive type used as a display apparatus for various apparatuses. Three different settings "64", "16" and "2" are enabled as the number of gray scale levels in an electro-optical apparatus, the number of subfields becoming smaller as the number of gray scale levels is reduced. When a large number of gray scale levels is not required (when in the power-saving mode, the wait mode, etc.), a low number of gray scale levels is set, so that the own capacitance of a liquid crystal layer and storage capacitance are charged and discharged less often.

5 Claims, 15 Drawing Sheets

(a)

| GRAY SCALE DATA | Ds | | | | | | |
|---|---|---|---|---|---|---|---|
| | Sf0 | Sf1 | Sf2 | Sf3 | Sf4 | Sf5 | Sf6 |
| (000000) | H | L | L | L | L | L | L |
| (000001) | H | H | L | L | L | L | L |
| (000010) | H | L | H | L | L | L | L |
| (000011) | H | H | H | L | L | L | L |
| : | : | : | : | : | : | : | : |
| (111101) | H | H | L | H | H | H | H |
| (111110) | H | L | H | H | H | H | H |
| (111111) | H | H | H | H | H | H | H |

(b) WHEN FR = L

| Ds | VOLTAGE |
|---|---|
| H | V1 |
| L | 0 |

(c) WHEN FR = H

| Ds | VOLTAGE |
|---|---|
| H | -V1 |
| L | 0 |

[FIG. 1]
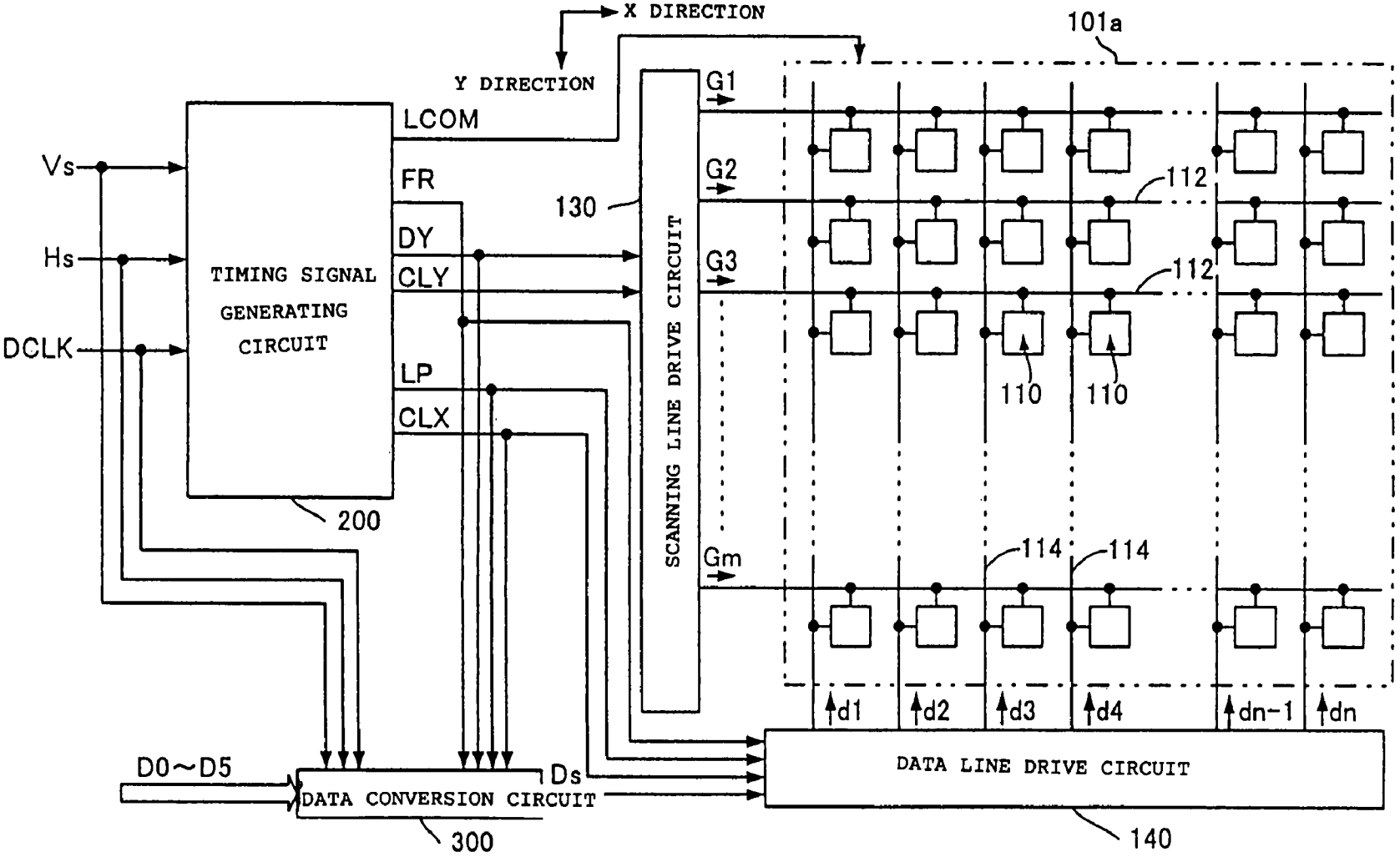

[FIG. 2]
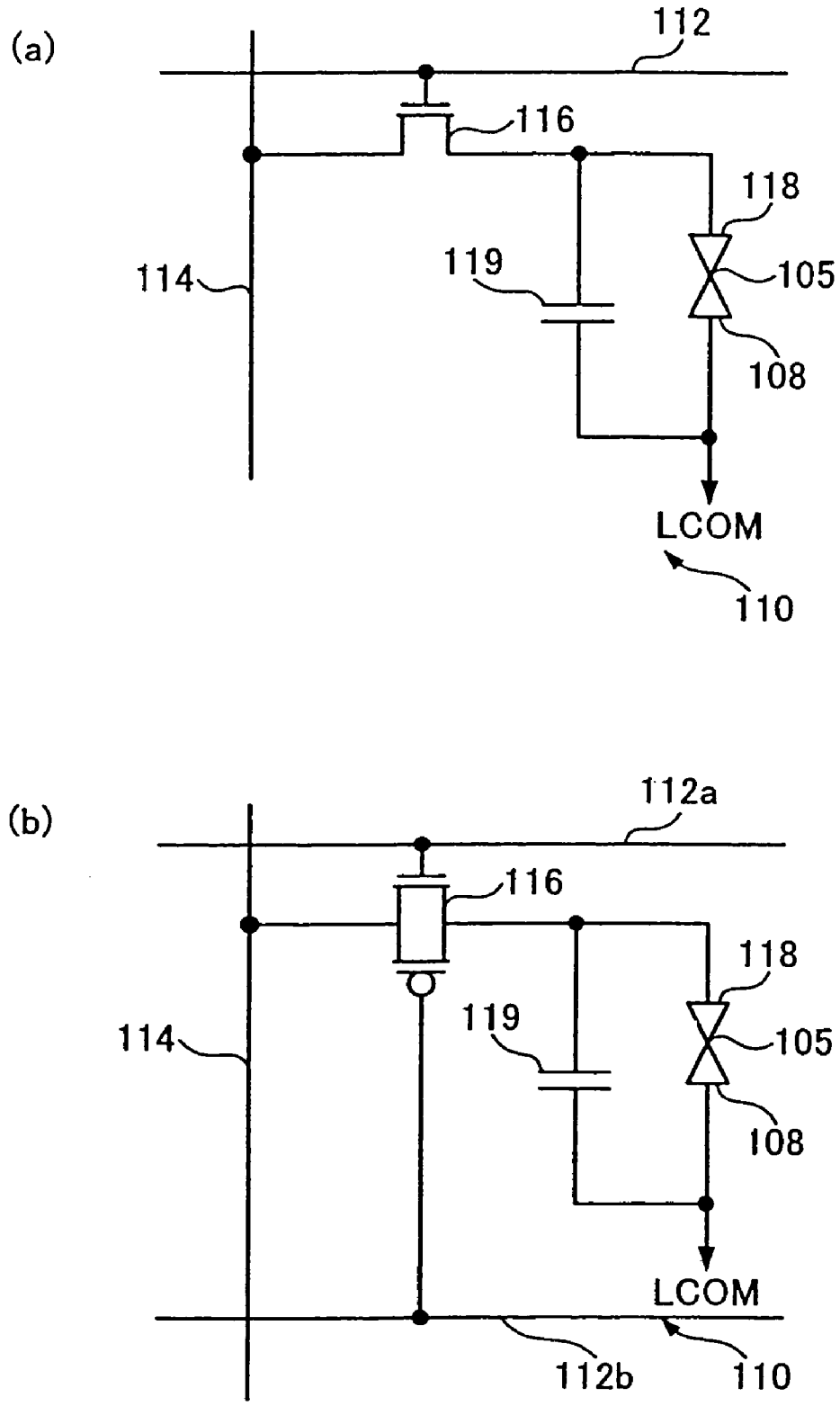

[FIG. 3]
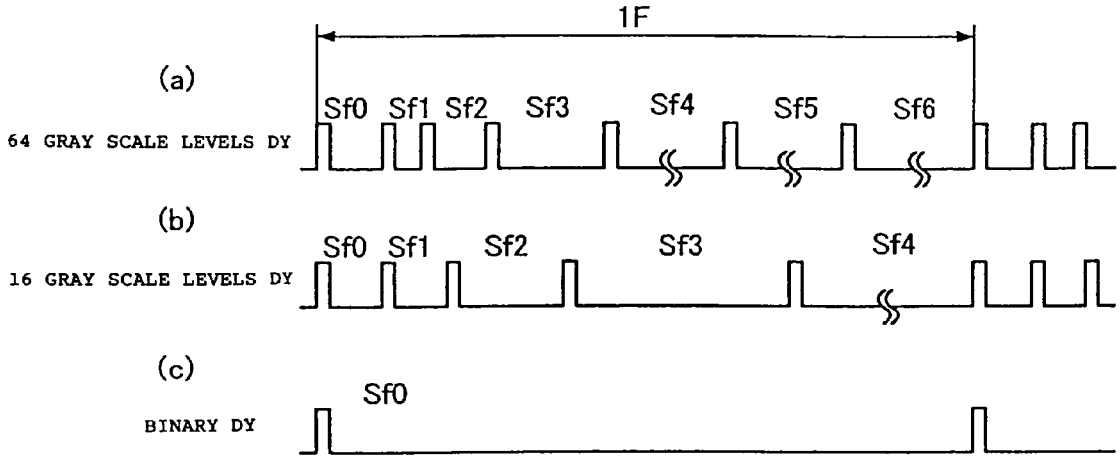

[FIG. 4]
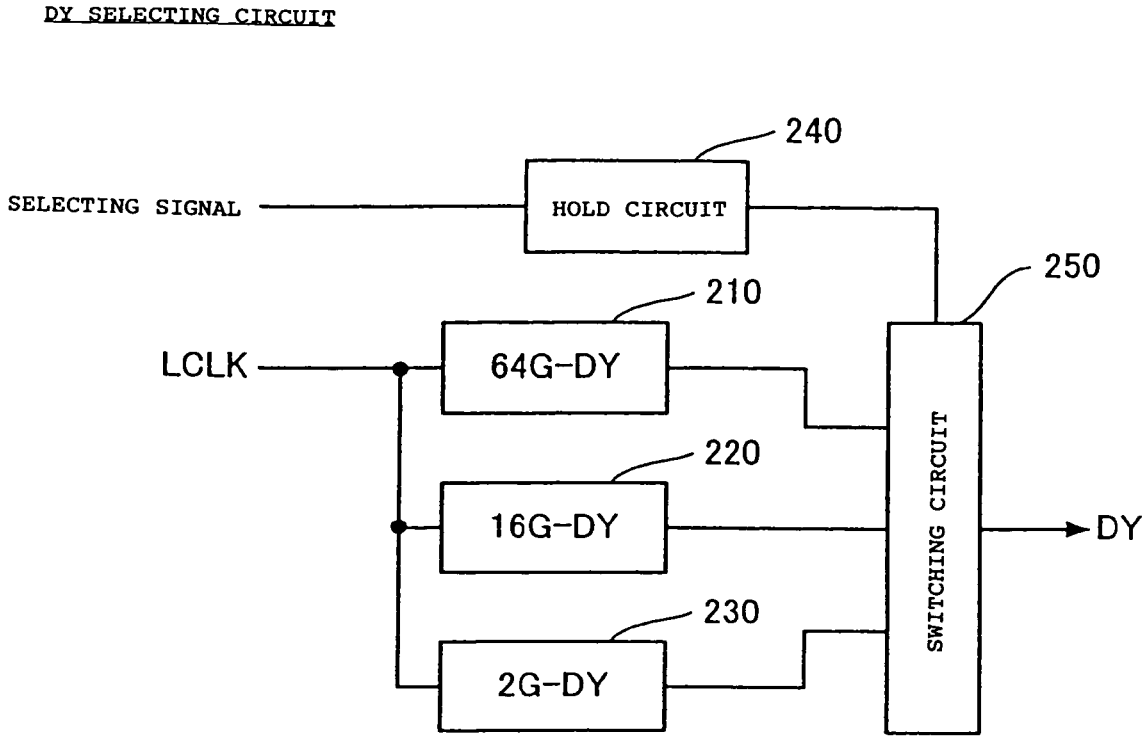

[FIG. 5]
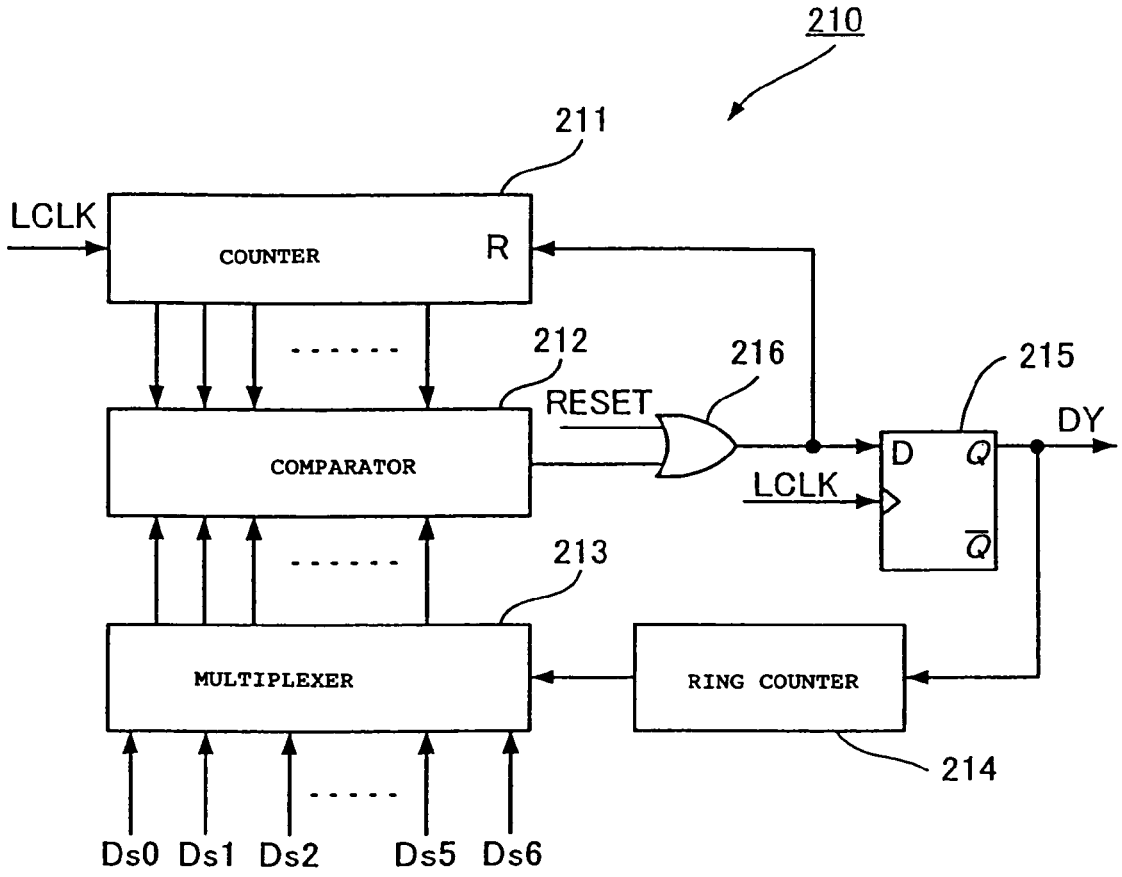

[FIG. 6]
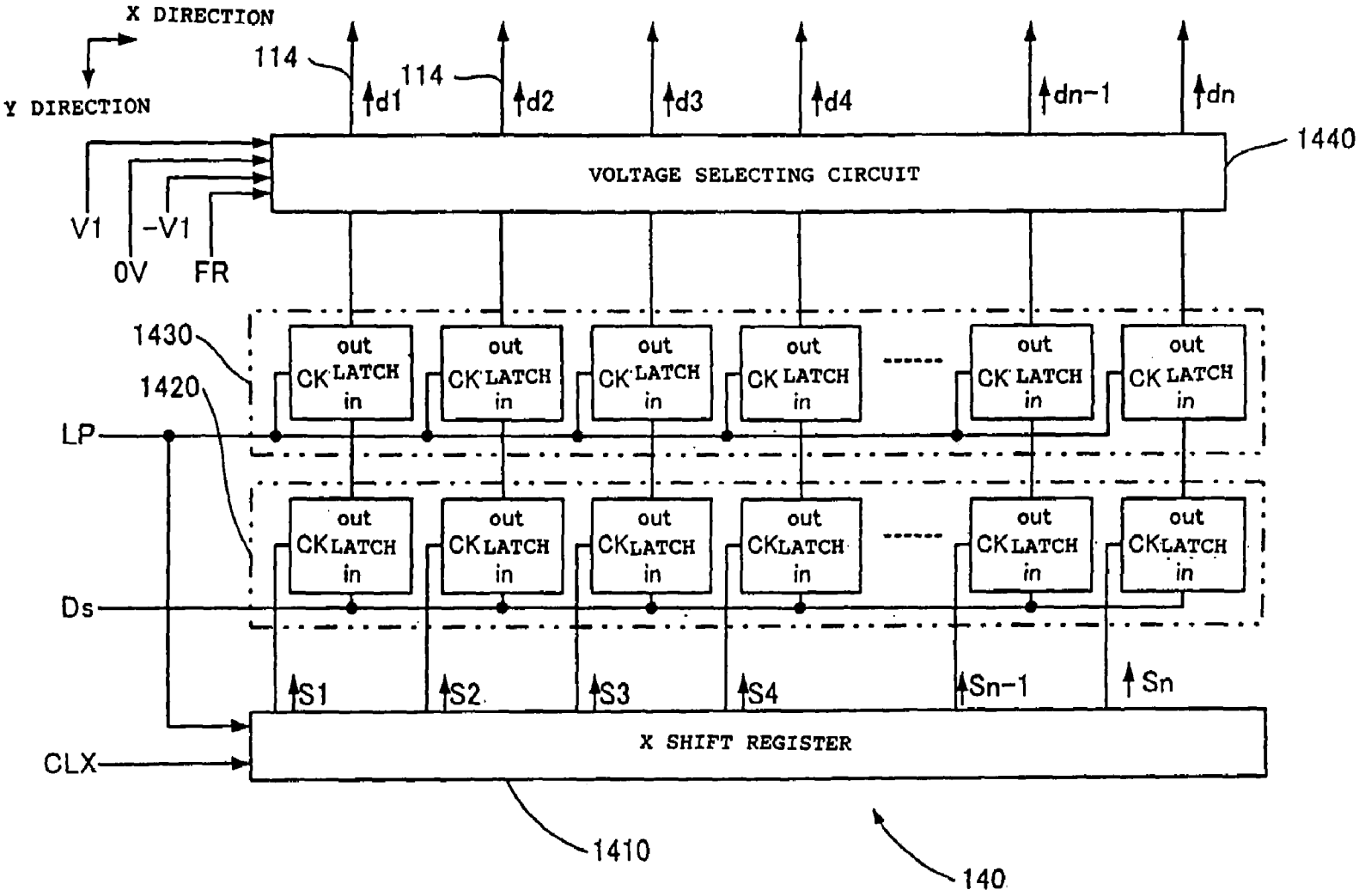

[FIG. 7]

(a)

| GRAY SCALE DATA | Ds | | | | | | |
|---|---|---|---|---|---|---|---|
| | Sf0 | Sf1 | Sf2 | Sf3 | Sf4 | Sf5 | Sf6 |
| (000000) | H | L | L | L | L | L | L |
| (000001) | H | H | L | L | L | L | L |
| (000010) | H | L | H | L | L | L | L |
| (000011) | H | H | H | L | L | L | L |
| : | : | : | : | : | : | : | : |
| (111101) | H | H | L | H | H | H | H |
| (111110) | H | L | H | H | H | H | H |
| (111111) | H | H | H | H | H | H | H |

(b) WHEN FR = L

| Ds | VOLTAGE |
|---|---|
| H | V1 |
| L | 0 |

(c) WHEN FR = H

| Ds | VOLTAGE |
|---|---|
| H | -V1 |
| L | 0 |

[FIG. 8]
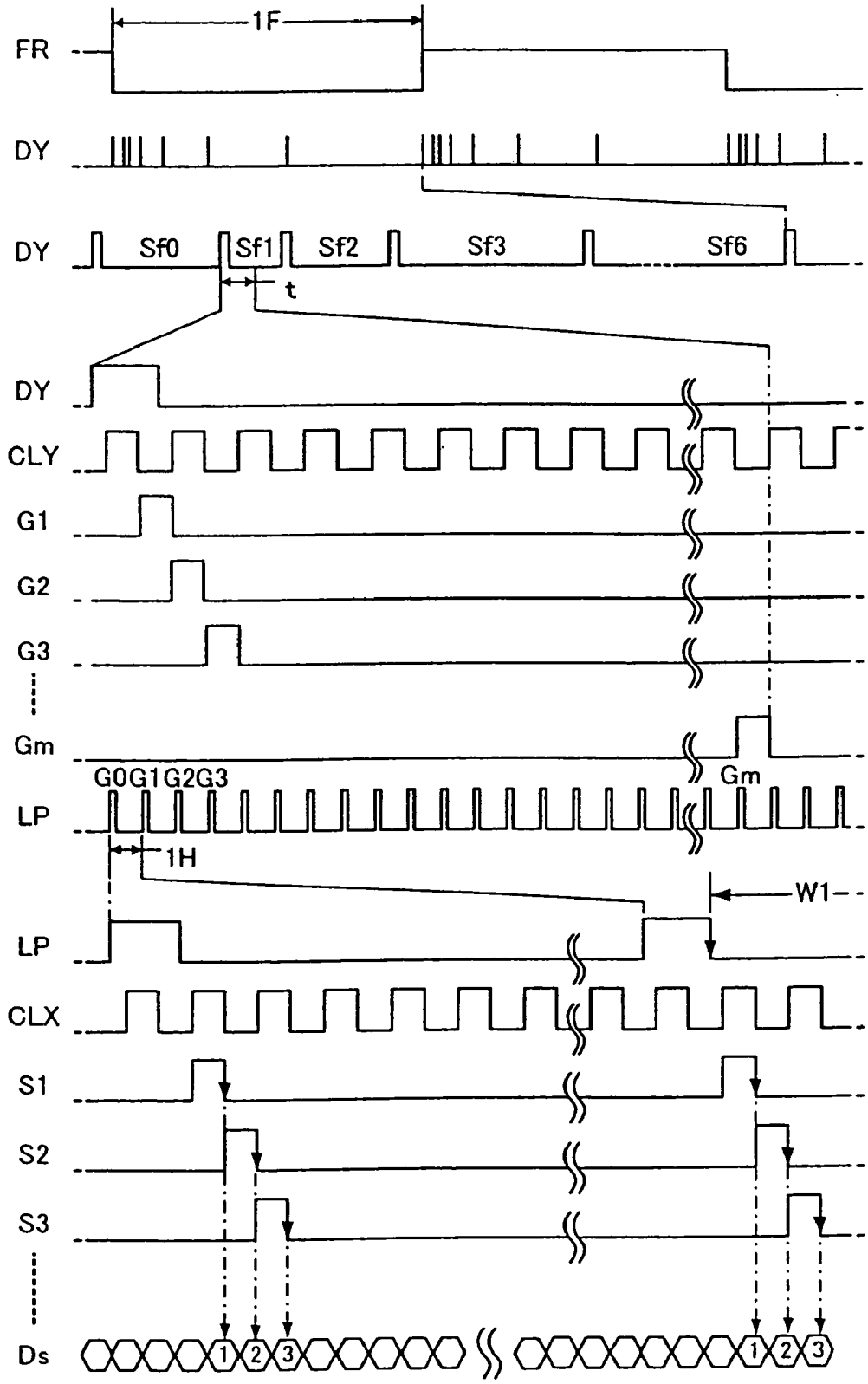

[FIG. 9]
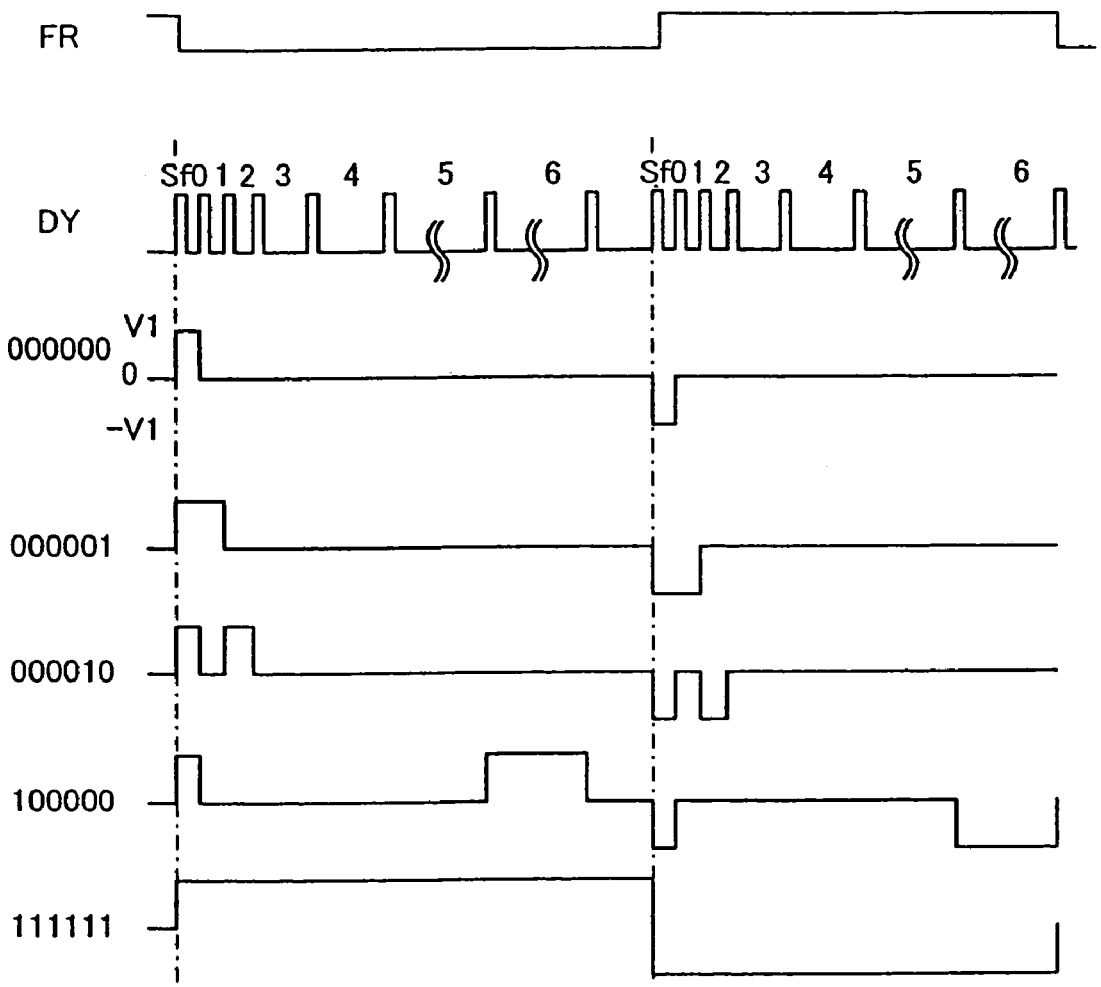

[FIG. 10]
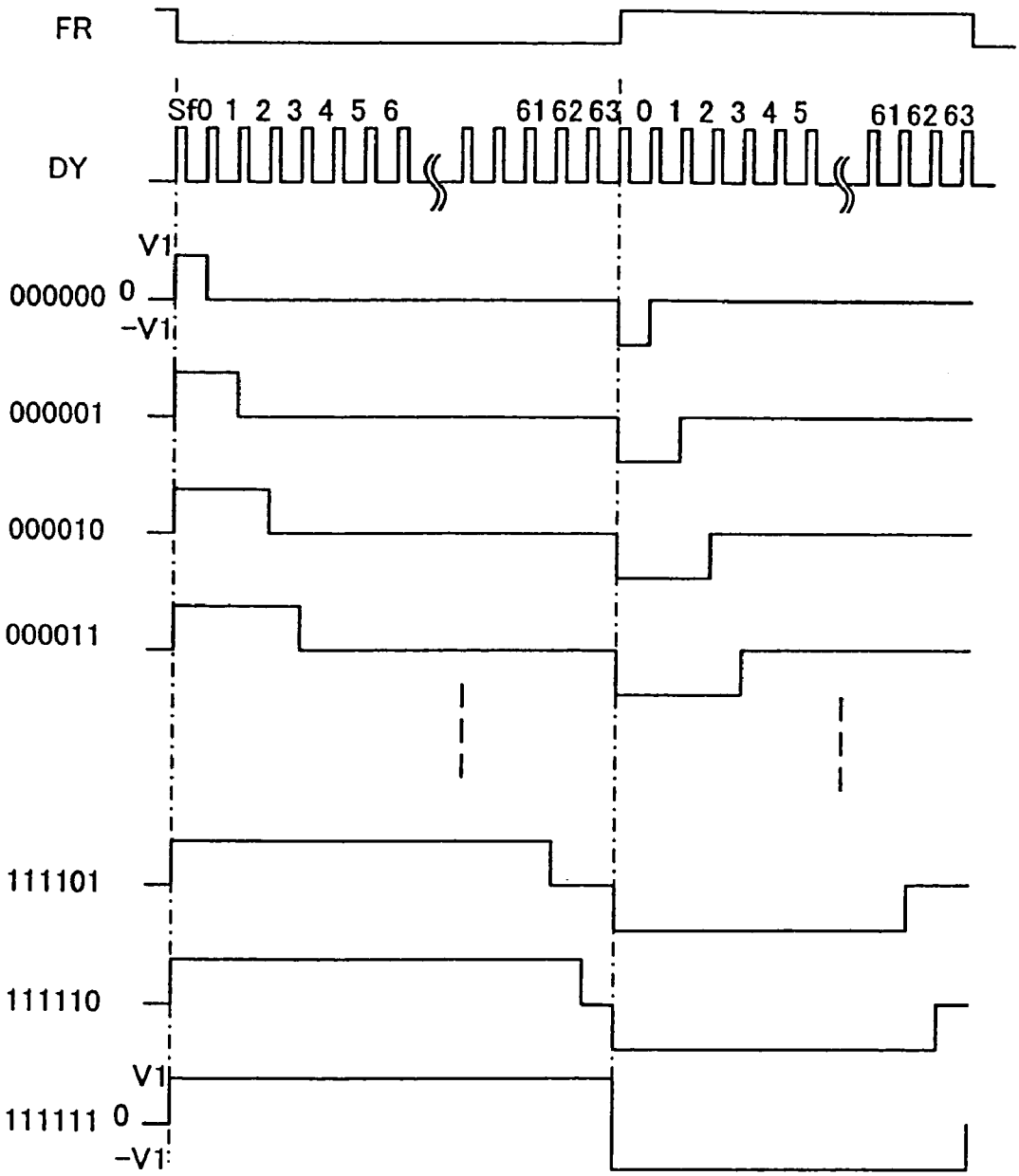

[FIG. 11]
(a)
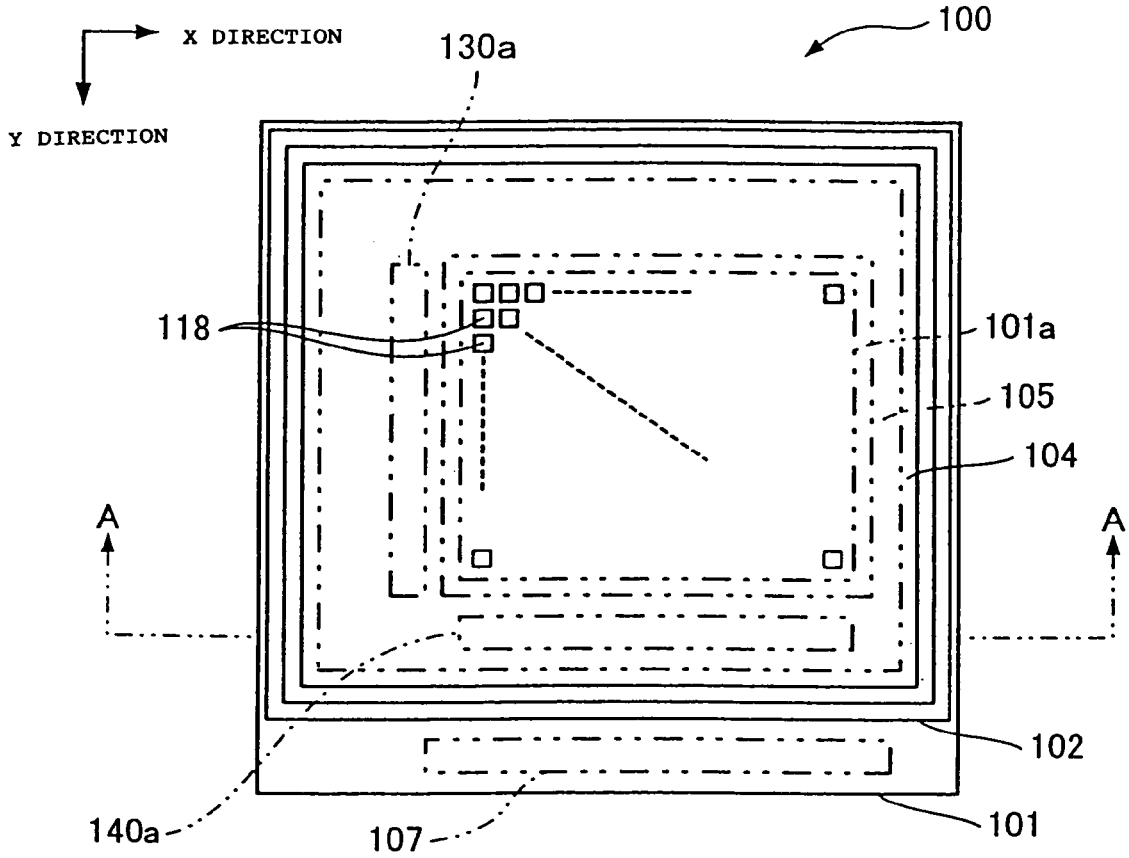
(b)
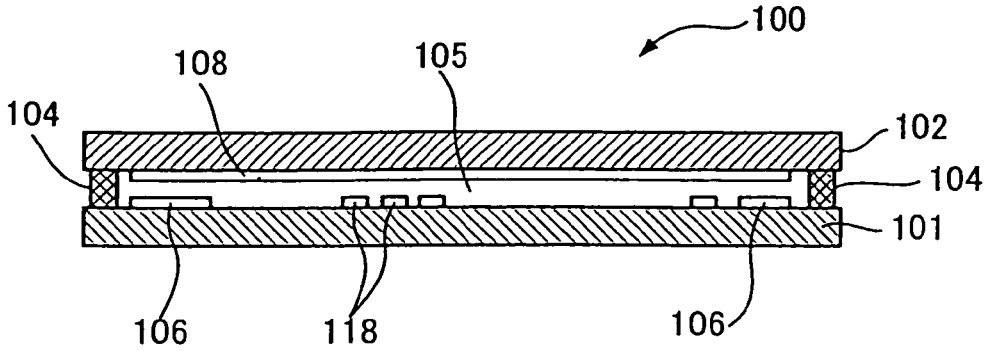

[FIG. 12]
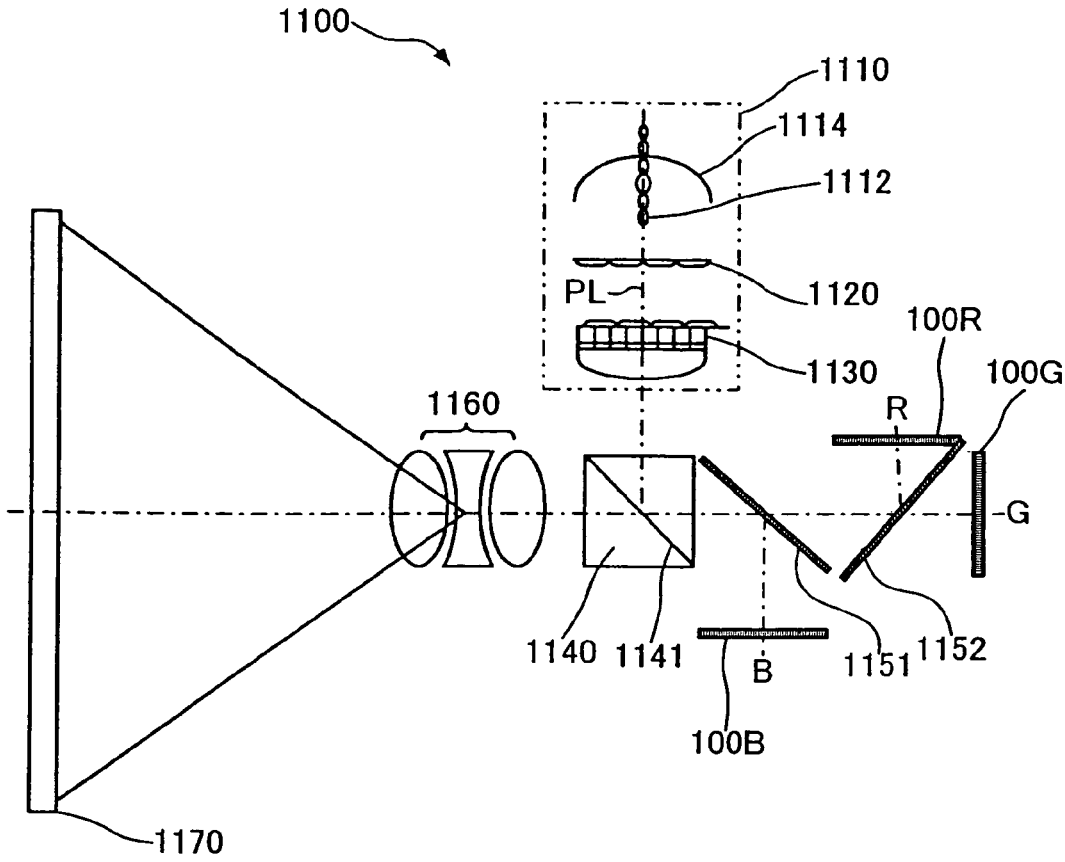

[FIG. 13]
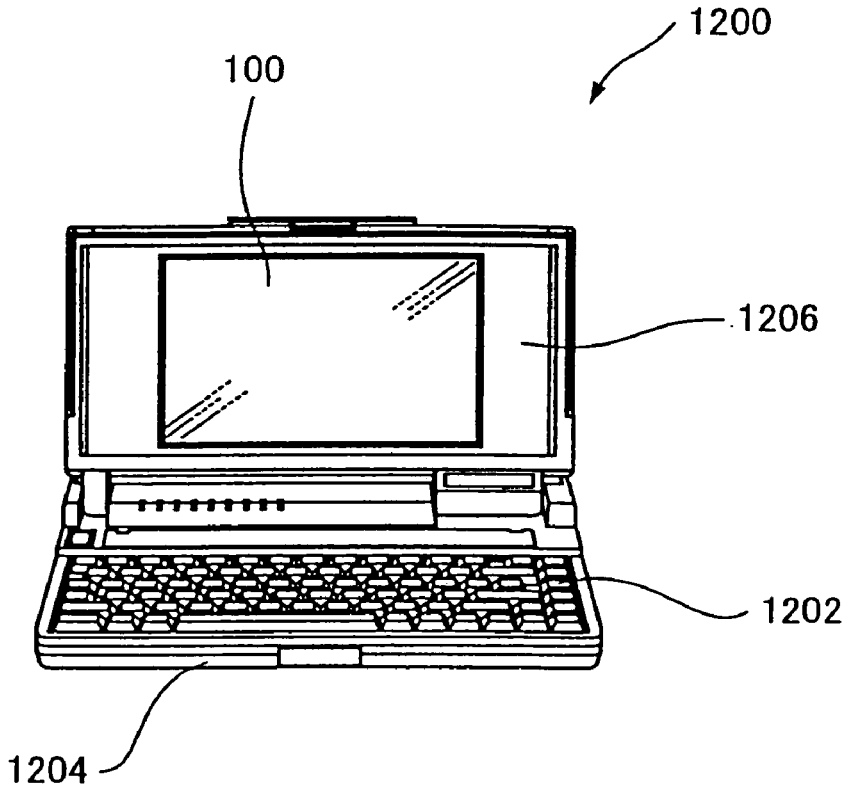

[FIG. 14]
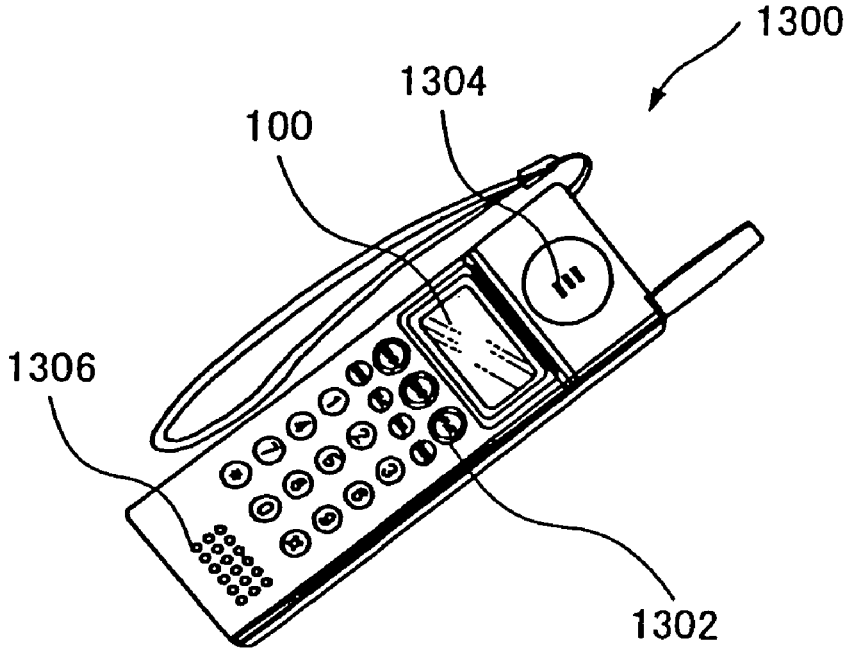

[FIG. 15]
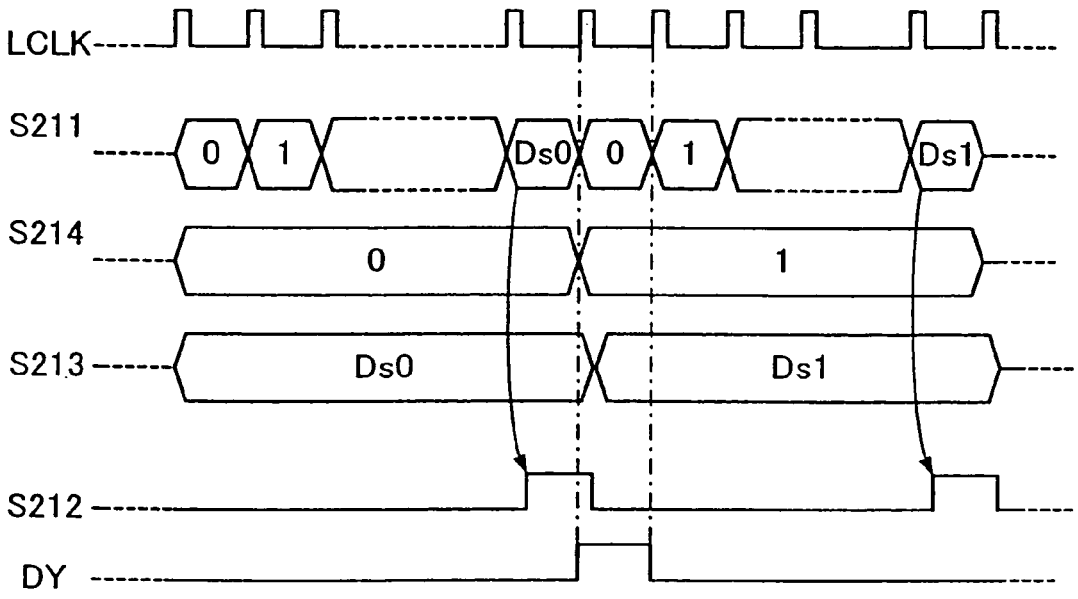

METHOD OF DRIVING ELECTRO-OPTICAL APPARATUS, DRIVE CIRCUIT FOR ELECTRO-OPTICAL APPARATUS, ELECTRO-OPTICAL APPARATUS, AND ELECTRONIC APPARATUS

BACKGROUND OF THE INVENTION

1. Field of Invention

The present invention relates to a method of driving an electro-optical apparatus, which is suitable for use in driving an electro-optical apparatus, a drive circuit for an electro-optical apparatus, an electro-optical apparatus, and an electronic apparatus.

2. Description of Related Art

Electro-optical apparatuses, for example, liquid crystal display apparatuses which use liquid crystal as an electro-optical material, are widely used in display units of various information processing apparatuses and liquid crystal television sets as an alternative display device to cathode ray tubes (CRT). A conventional electro-optical apparatus is constructed, for example, as follows. That is, the conventional electro-optical apparatus includes a device substrate on which pixel electrodes arranged in a matrix, and switching elements, such as TFTs (Thin Film Transistors) connected to the pixel electrodes, are formed; an opposing substrate on which an opposing electrode is formed opposing the pixel electrodes; and liquid crystal, as an electro-optical material, filled between the substrates.

In this structure, when a scanning signal is applied to the switching elements via scanning lines, the switching elements are turned on. When an image signal of a voltage in accordance with the gray scale level is applied to the pixel electrodes via data lines while the electrical connection is on, a charge corresponding to the voltage of the image signal is stored in the liquid crystal layer between the pixel electrodes and the opposing electrode. Even if the switching elements are turned off after the charge has been stored, the charge stored in the liquid crystal layer is maintained due to the capacitance of the liquid crystal layer and storage capacitance. When the charge stored is controlled in accordance with the gray scale level by driving the switching elements, the orientation of the liquid crystal changes on a pixel-by-pixel basis, the gray scale level thus changing on a pixel-by-pixel basis, whereby gray scale display is enabled.

At this time, the charge has to be stored in the liquid crystal layer of each of the pixels during only a short period, a time division multiplexed driving, in which the scanning lines and the data lines are grouped for a plurality of pixels, is enabled, by an arrangement such that a scanning line drive circuit first selects each of the scanning lines sequentially, a data line drive circuit next selects each of the data lines sequentially during the period when the scanning lines are selected, and an image signal of a voltage in accordance with the gray scale level is then sampled to selected data lines.

However, the image signal supplied to the data lines has a voltage corresponding to the gray scale, i.e., is an analog signal. Thus, in the peripheral circuitry of the electro-optical apparatus, a D/A conversion circuit, op amps, etc. are required, incurring higher cost of the overall apparatus. In addition, the display may not be uniform due to non-uniformity of the characteristics of the D/A conversion circuit, op amp, etc. and various line resistance, inhibiting display of a high quality, which becomes particularly prominent when the display requires a high resolution.

Furthermore, with regard to the electro-optical material, such as liquid crystal, the relationship between the voltage applied and the transmissivity varies depending on the type of the electro-optical material. Thus, it is desired that the drive circuit for driving the electro-optical apparatus be of the general-purpose type which is compatible with various electro-optical apparatuses.

In view of the above situation, the applicant has developed a technique to divide a single frame into a plurality of subfields, and turn on and off each of the pixels in each of the subfields. In accordance with this technique, the voltage applied when the pixels are turned on and off within a subfield is constant regardless of the gray scale level, and the gray scale level of the pixels is determined by the duty ratio (or effective voltage value) of the pixels within a single frame in the ON state.

When the gray scale level of the electro-optical apparatus is observed while changing the duty ratio in a range of 0 to 100%, a range exists near the duty ratio 0% or 100% in which the gray scale level does not change even though the duty ratio changes. The manner in which the range is generated varies depending on the composition of the liquid crystal; the range may be generated only near the duty ratio 0%, only near 100%, or both. Thus, corresponding to the ranges in which the gray scale level does not change, some subfields exist which are always set to on or off regardless of the specified gray scale level.

When the ON/OFF state of each of the pixels is changed at a boundary of subfields, storage capacitance, etc. is charged and discharged. Thus, during the period of charging and discharging, power consumption in the electro-optical apparatus and the drive circuit thereof is larger compared with other periods. Because the number of subfields increases as the number of gray scale levels in the electro-optical apparatuses increases, power consumption increases in accordance with the number of gray scale levels. For the same reason, power consumption associated with the signal lines and the scanning lines also increases.

However, even if a large number of gray scale levels is required in the electro-optical apparatus, it does not mean that display with the large number of gray scale levels is always required. For example, when a cellular phone is in a wait mode or a personal computer is in a power-saving mode, an electro-optical apparatus (e.g. a liquid crystal display) incorporated therein only requires simple display, and electric power is wasted if the large number of gray scale levels is maintained in such situations.

SUMMARY OF THE INVENTION

The present invention has been made in view of the above situation, and an object thereof is to provide a method of driving an electro-optical apparatus, a drive circuit for an electro-optical apparatus, an electro-optical apparatus, and an electronic apparatus, in which power consumption can be reduced in accordance with different situations.

In order to achieve the above object, the present invention includes the structures described in detail below.

A method of driving an electro-optical apparatus according to the present invention includes selectively setting the number of subfields within a frame in accordance with a signal specifying the number of gray scale levels (gray scale number selecting signal); and dividing said frame into the specified number of subfields and controlling on or off of each of the pixels in each of said subfields in accordance with the gray scale level of the pixels.

In accordance with the present invention as discussed above, the number of gray scale levels can be controlled in accordance with the operation mode required for the electro-optical apparatus, enabling reduction of power consumption in accordance with different situations.

Furthermore, said pixels can be provided in association with each of the intersections of a plurality of scanning lines and a plurality of data lines, so that when a scanning signal is applied to the associated scanning line, the pixels are turned on and off according to the voltages applied to the associated data line. Further, the invention can include, for each of said subfields, supplying said scanning signal sequentially to each of said scanning lines, and supplying a signal which specifies on or off in accordance with the gray scale level for each of the pixels sequentially to each of the data lines corresponding to each of the pixels.

Furthermore, a drive circuit for an electro-optical apparatus according to the present invention drives pixels including pixel electrodes disposed in association with each of the intersections of a plurality of scanning lines and a plurality of data lines, and switching elements provided in association with each of said pixel electrodes and which electrically connects the associated data line and the associated pixel electrode when a scanning signal is supplied to the associated scanning line. The drive circuit includes a scanning line drive circuit that supplies said scanning signal sequentially to each of said scanning lines for each of the subfields constituting a frame; a data line drive circuit that supplies a signal which specifies on or off of each of said pixels for each of said subfields in accordance with the gray scale levels of each of said pixels to the data lines associated with the pixels during the period when said scanning signal is supplied to the scanning lines respectively corresponding to the pixels; and a subfield number setting circuit that selectively sets the number of subfields within said frame in accordance with said signal which specifies the number of gray scale levels (gray scale number selecting signal).

In accordance with the present invention described above, the number of gray scale levels can be controlled in accordance with the operation mode required for the electro-optical apparatus, achieving a drive circuit which serves to reduce power consumption in accordance with different situations.

Furthermore, an electro-optical apparatus according to the present invention includes a device substrate provided with pixel electrodes disposed in association with each of the intersections of a plurality of scanning lines and a plurality of data lines, and switching elements provided in association with each of said pixel electrodes, which controls the electrical connection between the associated data line and the associated pixel electrode based on a scanning signal which is supplied via the associated scanning line; an opposing substrate provided with an opposing electrode disposed opposing said pixel electrodes; an electro-optical material (liquid crystal) interposed between said device substrate and said opposing substrate; a scanning line drive circuit that supplies said scanning signal sequentially to each of said scanning lines for each of the subfields constituting a frame; a data line drive circuit that supplies a signal which specifies on or off of each of said pixels for each of said subfields in accordance with the gray scale levels of each of said pixels to the data lines associated with the pixels during the period when said scanning signal is supplied to the scanning lines respectively corresponding to the pixels; and a subfield number setting circuit that sets the number of subfields within said frame in accordance with a gray scale level number specifying signal (gray scale level number selecting signal) which specifies the number of said gray scale levels.

In accordance with the present invention as described above, the number of gray scale levels can be controlled in accordance with the operation mode required for the electro-optical apparatus, enabling reduction of power consumption of the electro-optical apparatus in accordance with different situations.

Furthermore, an electronic apparatus according to the present invention includes the electro-optical apparatus as described above; and a control circuit which supplies said gray scale level number specifying signal to said subfield number setting circuit.

BRIEF DESCRIPTION OF THE DRAWINGS

FIG. 1 is a schematic showing the electrical construction of an electro-optical apparatus according to an embodiment of the present invention;

FIGS. 2(*a*) and 2(*b*) are circuit diagrams showing an example of the construction of a pixel in the embodiment;

FIGS. 3(*a*)–3(*c*) are timing charts of a start pulse DY for each number of gray scale levels in the embodiment;

FIG. 4 is a schematic of a start pulse DY selecting circuit in the embodiment;

FIG. 5 is a schematic of a start pulse generating circuit 210 in the embodiment;

FIG. 6 is a schematic of a data line drive circuit 140 in the embodiment;

FIGS. 7(*a*)–7(*c*) are charts showing the conversion of gray scale data in a data conversion circuit 300 in the embodiment;

FIG. 8 is a timing chart of the electro-optical apparatus according to the embodiment;

FIG. 9 is a timing chart showing the relationship between the gray scale data and a waveform applied to pixel electrodes 118 in the embodiment;

FIG. 10 is a timing chart showing the relationship between the gray scale data and a waveform applied to pixel electrodes 118 in a modification of the embodiment;

FIGS. 11(*a*)–11(*b*) are schematics of the electro-optical apparatus according to the embodiment;

FIG. 12 is a schematic showing the construction of a projector 1100 which is an example of an electronic apparatus to which the electro-optical apparatus is applied;

FIG. 13 is a perspective view of the front of a mobile computer 1200 which is an example of an electronic apparatus to which the electro-optical apparatus is applied;

FIG. 14 is a perspective view of a cellular phone 1300 which is an example of an electronic apparatus to which the electro-optical apparatus is applied;

FIG. 15 is a timing chart of a start pulse generating circuit 210 in the embodiment.

DETAILED DESCRIPTION OF PREFERRED EMBODIMENTS

1. Construction of the Embodiment

Next, the construction of an electro-optical apparatus according to an embodiment of the present invention will be described with reference to FIG. 1.

Referring to FIG. 1, a timing signal generating circuit 200 generates various timing signals and clock signals as described below, in accordance with a vertical scanning signal Vs, a horizontal scanning signal Hs, and a dot clock signal DCLK, which are supplied from an upper apparatus not shown. First, a field reverse signal FR is a signal whose polarity reverses on a frame-by-frame basis. A drive signal LCOM is a signal which is applied to opposing electrodes on an opposing substrate, and is at a constant voltage (zero voltage) in this embodiment. A start pulse DY is a pulse signal which is output at the beginning of each subfield. A clock signal CLY is a signal which defines a horizontal scanning period of the scanning side (Y side). A latch pulse LP is a pulse signal which is output at the beginning of a horizontal scanning period, and is output at the time of a level transition (i.e., rise and fall) of the clock signal CLY. A clock signal CLX is a signal which defines what is called a dot clock.

Meanwhile, in a display area 101*a* on a device substrate 101, a plurality of scanning lines 112 are formed extending in the X (row) direction in FIG. 1. Also, a plurality of data lines 114 are formed extending along the Y (column) direction. Furthermore, pixels 110 are provided in association with each of the intersections of the scanning lines 112 and the data lines 114, and are arranged in a matrix. For the convenience of the description, the description will be made assuming that, in this embodiment, the total number of the scanning lines 112 is m and the total number of the data lines 114 is n (m and n each being an integer greater than or equal to 2), forming an m×n matrix display apparatus; however, this is not intended to limit the present invention thereto.

1.1 <Construction of the Pixels>

The construction of a pixel 110 may be, for example, as shown in FIG. 2(*a*). In this construction, the gate of a transistor (MOSFET) 116 is connected to a scanning line 112, the source to a data line 114, and the drain to a pixel electrode 118, respectively, and liquid crystal 105, which is an electro-optical material, is interposed between the pixel electrode 118 and an opposing electrode 108, forming a liquid crystal layer. As will be described below, the opposing electrode 108 is actually a transparent electrode which is formed over the entire opposing substrate so as to oppose pixel electrodes 118. Furthermore, a storage capacitor 119 is formed between the pixel electrode 118 and the opposing electrode 108, preventing the leakage of an electric charge stored in the liquid crystal layer. Although the storage capacitor 119 is formed between the pixel electrode 118 and the opposing electrode 108 in this embodiment, it may be formed between the pixel electrode 118 and the ground potential GND, between the pixel electrode 118 and the gate line, etc.

In the construction shown in FIG. 2(*a*), an offset voltage is required because the transistor 116 uses only one channel type; however, if the construction is such that a P-channel transistor and an N-channel transistor are combined complementarily as shown in FIG. 2(*b*), the effect of the offset voltage can be cancelled. In the complementary construction, however, two scanning lines 112*a* and 112*b* are required for one row of pixels 110 because scanning signals of mutually exclusive levels must be supplied.

1.2 <Start Pulse Generating Circuit>

In this embodiment, as described above, the switching of subfields is controlled by the start pulse DY. The start pulse DY is generated in the timing signal generating circuit 200, and the rise timing of the start pulse DY is set in accordance with the number of gray scale levels required in the electro-optical apparatus, as shown in FIGS. 3(*a*)–3(*c*). First, in the case where the number of gray scale levels is "64", shown in FIG. 3(*a*), the start pulse DY rises at the beginning of a frame, and a subfield Sf0 starts. The subfield Sf0 is a subfield which is set to the ON state regardless of the gray scale level of the corresponding pixel.

Then, the start pulse DY rises six times, the periods between the timing of each rise and the timing of the next rise (the period until the next frame as for the last subfield Sf6) being subfields Sf1 to Sf6, respectively. The length of the subfield Sf1 is set to substantially "1/63" of "the length of one frame—the length of Sf0", and the lengths of the subfields Sf2 to Sf6 are set to substantially twice that of the previous subfield. If the number of gray scale levels of image data is 64, each of the pixel values can be represented as 6-bit data, for example, "001010", the ON/OFF state of the subfields Sf1 to Sf6 sequentially corresponding to the values of the LSB to MSB of the pixel value.

Next, FIG. 3(*b*) shows the rise timing of the start pulse DY in the case where the number of gray scale levels is "16". Similarly to the case where the number of gray scales is "64", the first subfield Sf0 is a subfield which is set to the ON state regardless of the gray scale level of the corresponding pixel.

Then, the start pulse DY rises four times, the period between each rise timing and the next rise timing (the period until the next frame as for the last subfield Sf4) being subfields Sf1 to Sf4, respectively. The length of the sub-filed Sf1 is set to substantially "1/15" of "the length of one frame—the length of Sf0", and the lengths of the subfields Sf2 to Sf4 are set to substantially twice that of the previous subfield. In the case where the number of gray scales is "16", the sixteen gray scale levels are represented using D0 to D3 of gray scale data D0 to D5, and a binary signal Ds is output from a data conversion circuit 300 so that D0, D1, D2, and D3 correspond to the subfields Sf1, Sf2, Sf3, and Sf4, respectively. Next, FIG. 3(*c*) shows the rise timing of the start pulse DY in the case where the number of gray scale levels is "2". In this case, "one frame" is formed of only a subfield Sf0, and the rise timing of the start pulse DY coincides with the start timing of each frame. In the case of display using two gray scale levels, the two gray scale levels are represented using D0 of the gray scale data D0 to D5, and a binary signal Ds is output from the data conversion circuit 300 so that D0 corresponds to the subfield Sf0.

Next, FIG. 4 shows the construction of a start pulse DY selecting circuit which selects the start pulse DY in accordance with the number of gray scale levels. FIG. 4 shows a hold circuit 240, which receives a gray scale level number selecting signal corresponding to the number of gray scale levels and which then holds the content thereof. The gray scale level number selecting signal is a signal which is generated by an upper apparatus which displays information using the electro-optical apparatus according to this embodiment, for example, a personal computer, a cellular phone, etc. Start pulse generating circuits 210, 220 and 230 are provided corresponding to the number of gray scale levels "64", "16", and "2", respectively, which generate the start pulses DY shown in FIGS. 3(*a*) to 3(*c*), respectively, based on a line clock signal LCLK which is in synchronization with the clock signal CLY. A switching circuit 250 is provided, which selects one of the start pulses DY output from each of the start pulse generating circuits 210, 220, and 230 based on the gray scale level number selecting signal held and which outputs the result of the selection as the final start pulse DY.

Next, FIG. 5 is a schematic of the start pulse generating circuit 210 corresponding to the number of gray scale levels "64". As shown in FIG. 5, the start pulse generating circuit 210 includes a counter 211, a comparator 212, a multiplexer 213, a ring counter 214, a D flip-flop 215, and an OR circuit 216. The counter 211 counts the line clock signal LCLK, and the count value is reset by an output signal from the OR circuit 216. To one of the input terminals of the OR circuit 216, a reset signal RSET, which is at H level only for one cycle of the line clock signal LCLK, is supplied at the beginning of a frame. Thus, the count value of the counter 211 is reset at least at the beginning of a frame.

FIG. 15 is a timing chart of the start pulse generating circuit 210. As shown in FIG. 15, the comparator 212 compares the count value S211 of the counter 211 and the output data value S213 of the multiplexer 213, and if they coincide, it outputs a coincidence signal S212 at H level. The multiplexer 213 selectively outputs the data DS0, DS1, . . . , DS6 based on the count result S214 of the ring counter 214 which counts the start pulse DY. The data DS0, DS1, . . . , DS6 correspond to the subfields Sf0, Sf1, Sf2, . . . , Sf6 shown in FIG. 3(*a*), respectively. The data DS0 or the subfield Sf0 is determined in accordance with the threshold voltage Vth (the effective voltage value at which the gray scale level begins to change in response to the change in the effective voltage value) of the liquid crystal, and can be made variable. For example, it may be predetermined for each product type of the electro-optical apparatus, or may be adjusted at the time of shipping in order to compensate for variations among products.

The comparator 212 outputs the coincidence signal S212 when the count value of the counter reaches a boundary of subfields. Because the coincidence signal is fed back to the reset terminal of the counter 211 via the OR circuit 216, the counter 211 restarts counting from the boundary of subfields. The D flip-flop 215 latches the output signal from the OR circuit 216 on the basis of the line clock signal LCLK, generating the start pulse DY. Thus, the start pulse DY rises at the timing when the line clock signal LCLK rises for the first time after the coincidence signal S212 has risen. Meanwhile, when the line clock signal LCLK rises, the counter value S211 and the output data value S213 no longer coincide; thus, the coincidence signal S212 goes to L level. The next time the line clock signal LCLK rises, the L level coincidence signal S212 is latched by the D flip-flop 215, the start pulse DY thus going to L level.

Although the construction of the start pulse generating circuit 210 for the number of gray scale levels "64" has been described hereinabove, the start pulse generating circuits 220 and 230 for other numbers of gray scale levels are constructed similarly thereto.

1.3 <Scanning Line Drive Circuit>

The description now returns to FIG. 1. A scanning line drive circuit 130 is what is called a Y shift register, which transfers, on the basis of the clock signal CLY, start pulses DY which are supplied at the beginning of each subfield and which exclusively supplies them to each of the scanning lines 112 sequentially as scanning signals G1, G2, G3, . . . , Gm.

1.4 <Data Line Drive Circuit>

A data line drive circuit 140 sequentially latches n binary signals Ds corresponding to the number of the data lines 114 in a horizontal scanning period, and simultaneously supplies the latched n binary signals Ds to the corresponding data lines 114 via a voltage selecting circuit 1440 in the next horizontal scanning period as data signals d1, d2, d3, . . . dn. The specific construction of the data line drive circuit 140 is shown in FIG. 6. That is, the data line drive circuit 140 includes an X shift register 1410, a first latch circuit 1420, a second latch circuit 1430, and the voltage selecting circuit 1440.

The X shift register 1410 transfers, on the basis of the clock signal CLX, latch pulses LP which are supplied at the beginning of each horizontal scanning period, exclusively supplying them sequentially as latch signals S1, S2, S3, . . . , Sn. Next, the first latch circuit 1420 sequentially latches the binary signals Ds at the fall of the latch signals S1, S2, S3, . . . , Sn. Then, the second latch circuit 1430 simultaneously latches each of the binary signal Ds latched by the first latch circuit 1420 at the fall of the latch pulses LP, and transfers them to the voltage selecting circuit 1440.

The voltage selecting circuit 1440 converts the latched binary signals into voltages on the basis of the field reverse signal FR, and applies them to the data lines 114 as data signals d1, d2, d3, . . . , dn. More specifically, if the field reverse signal FR is at L level, H level of the data signals d1, d2, d3, . . . , dn is converted to a voltage V1, while L level thereof is converted to zero voltage. On the contrary, if the field reverse signal FR is at H level, H level of the data signals d1, d2, d3, . . . , dn is converted to a voltage —V1, while L level thereof is converted to zero voltage.

1.5 <Data Conversion Circuit>

Next, the data conversion circuit 300 will be described. In order to write H level or L level in accordance with the gray scale level for each of the subfields Sf1 to Sf6, gray scale data corresponding to the pixels must be converted in some way. Also, in order to write a binary voltage so that a voltage Va at which the transmissivity of the liquid crystal begins to rise from 0% is applied to the liquid crystal layer as an effective voltage, during the period of the subfield Sf0, a voltage of H level must be applied to the liquid crystal layer. The data conversion circuit 300 in FIG. 1 is provided for this purpose. More specifically, the data conversion circuit 300 converts the 6-bit gray scale data D0 to D5 corresponding to each of the pixels, which is supplied in synchronization with the horizontal scanning signal Hs and the dot clock signal DCLK, into the binary signals Ds for each of the subfields Sf1 to Sf6, and supplies the binary signals Ds at H level to each of the pixels during the period of the subfield Sf0.

The data conversion circuit 300 requires an arrangement that recognizes a subfield within a frame. With regard to the arrangement, for example, the following method allows the recognition. That is, in this embodiment, because the field reverse signal FR which reverses on a frame-by-frame basis is generated in order to allow alternating drive, a counter is provided in the data conversion circuit 300, which counts the start pulse DY and whose count result is reset at the level transitions (rise and fall) of the field reverse signal FR, so that the current subfield, etc. can be recognized by referencing the count result.

Because the binary signals Ds must be output in synchronization with the operations of the scanning line drive circuit 130 and the data line drive circuit 140, the start pulse DY, the clock signal CLY which is in synchronization with the horizontal scanning, the latch pulse LP which defines the beginning of a horizontal scanning period, and the clock signal CLX which is equivalent to the dot clock signal, are supplied. Furthermore, as described above, because the arrangement is such that, in the data line drive circuit 140, the first latch circuit 1420 latches the binary signals dot by dot sequentially in a horizontal scanning period, and then the second latch circuit 1430 latches data for one scanning line in the next horizontal scanning period, simultaneously supplying them as the data signals d1, d2, d3, . . . , dn to each of the data lines 114 via the voltage selecting circuit 1440, the arrangement is such that the data conversion circuit 300 outputs the binary signals Ds at the timing which is one cycle of horizontal scanning period ahead compared with the operations of the scanning line drive circuit 130 and the data line drive circuit 140. The data line drive circuit 140 converts the binary signals Ds in accordance with the level of the field reverse signal FR for output as shown in FIGS. 7(*b*) and 7(*c*).

1.6 <Construction of the Liquid Crystal Apparatus>

The construction of the electro-optical apparatus described above will be described with reference to FIGS. 11(*a*) and (*b*).

FIG. 11(*a*) is a plan view showing the construction of the electro-optical apparatus 100, and FIG. 11(*b*) is a sectional view taken along plane A—A' of FIG. 11(*a*). As shown in FIGS. 11(*a*) and 11(*b*), the construction of the electro-optical apparatus 100 is such that the device substrate 101, on which the pixel electrodes 118, etc. are formed, and the opposing substrate 102, on which the opposing electrodes 108, etc. are formed, are bonded via a sealing material 104 with a constant gap therebetween, the liquid crystal 105 as an electro-optical material being interposed within the gap. The sealing material 104 actually has a cutaway portion, through which the liquid crystal 105 is injected and sealed by a sealant, although not shown in FIGS. 11(*a*) and 11(*b*).

As described above, the device substrate is a semiconductive substrate and is opaque. For this reason, the pixel electrodes 118 are formed of a reflective metal, such as aluminum, and the electro-optic apparatus 100 is used as the reflective type. On the other hand, the opposing substrate 102 is formed of glass, etc. and is transparent.

On the device substrate 101, a light-blocking film 106 is provided in the area inside the sealing material 104 and outside the display area 101*a*. Within the area where the light-blocking film 106 is formed, the scanning line drive circuit 130 is formed in an area 130*a* and the data line drive circuit 140 is formed in an area 140*a*. That is, the light-blocking film 106 prevents light from being incident on the drive circuits formed in this area. To the light-blocking film 106, as well as to the opposing electrodes 108, the drive signal LCOM is applied. Thus, in the area where the light-blocking film 106 is formed, the voltage applied to the liquid crystal layer is substantially zero, achieving the same display status as when no voltage is applied to the pixel electrodes 118.

Furthermore, in the device substrate 101, in an area 107 outside the area 140*a* where the data line drive circuit 140 is formed and beyond the sealing material 104, a plurality of connection terminals are formed to which external control signals and power supply are input. Meanwhile, the opposing electrodes 108 on the opposing substrate 102 are electrically connected to the light-blocking film 106 and the connection terminals on the device substrate 101 via a conductive material (not shown) provided on at least one of the four corners of the bonding portion of the substrates. That is, the drive signal LCOM is applied to the light-blocking film 106 via the connection terminals provided on the device substrate 101 and also to the opposing electrodes 108 via the conductive material, respectively.

In addition, on the opposing substrate 102, depending on the application of the electro-optical apparatus 100, for example, when used as a direct-vision type, first, a color filter arranged in stripes, mosaic, triangle, etc. is provided, and second, for example, a light-blocking film (black matrix) formed of a metallic material, resin, etc. is provided. If the application is to modulate colored light, for example, when used as a light bulb in a projector to be described below, color filters are not formed. Furthermore, in the case of the direct-vision type, a front light, which emits light to the electro-optical apparatus 100 from the side of the opposing substrate 102, is provided as required. In addition, on the surfaces of the device substrate 101 and the opposing substrate 102 where the electrodes are formed, orientation films (not shown) which have been respectively rubbed in predetermined directions, etc, are provided, defining the orientation of the liquid crystal molecules when no voltage is applied, and on the side of the opposing substrate 102, a polarizer (not shown) in accordance with the orientation is provided. However, if liquid crystal of the polymer dispersion type in which minute particles are dispersed in polymer is used, the orientation films and the polarizer described above are not required, enhancing the efficiency of light energy, which is advantageous in increasing the luminance, reducing power consumption, etc.

2. Operation of the Embodiment

Next, the operation of the electro-optical apparatus according to the above-described embodiment will be described. FIG. 8 is a timing chart for explaining the operation of the electro-optical apparatus. First, the field reverse signal FR is a signal whose polarity reverses on the basis of one frame (1F). Meanwhile, the start pulse DY is supplied at the beginning of each subfield.

When the start pulse DY is supplied during a frame (1F) in which the field reverse signal FR is at L level, the scanning signals G1, G2, G3, . . . , Gm are exclusively output sequentially during a period (t) by the transfer by the scanning line drive circuit 130 (see FIG. 1) on the basis of the clock signal CLY. The period (t) is set to be even shorter than the shortest subfield.

Each of the scanning signals G1, G2, G3, . . . , Gm has a pulse width corresponding to a half cycle of the clock signal CLY. The scanning signal G1 corresponding to the uppermost scanning line 112 is output with a delay of at least a half cycle of the clock signal CLY from the first rise of the clock signal CLY after the start pulse DY has been supplied. Thus, one shot (G0) of the latch pulse LP is supplied to the data line drive circuit 140 after the start pulse DY has been supplied and before the scanning signal GI is output.

A case where the one shot (G0) of the latch pulse LP is supplied will be considered. First, when the one shot (G0) of the latch pulse LP is supplied to the data line drive circuit 140, the latch signals S1, S2, S3, . . . , Sn are exclusively output sequentially during a horizontal scanning period (1H) by the transfer by the data line drive circuit 140 (see FIG. 6) on the basis of the clock signal CLX. Each of the latch signals S1, S2, S3, . . . , Sn has a pulse width equivalent to a half cycle of the clock signal CLX.

At this time, the first latch circuit 1420 in FIG. 6 latches a binary signal Ds to a pixel 110 associated with the intersection of the uppermost scanning line 112 and the leftmost data line 114 at the fall of the latch signal S1, then latches a binary signal Ds to a pixel 110 associated with the intersection of the uppermost scanning line 112 and the second leftmost data line 114 at the fall of the latch signal S2, and thereafter, similarly, latches a binary signal Ds to a pixel 110 associated with the intersection of the uppermost scanning line 112 and the nth leftmost data line 114.

Thus, the binary signals Ds for one row of pixels associated with the intersections of the uppermost scanning line 112 in FIG. 1 are latched dot by dot sequentially by the first latch circuit 1420. It is to be understood that the data conversion circuit 300 converts the gray scale data D0 to D5 for each of the pixels into the binary signals Ds for output in accordance with the timing of the latching by the first latch circuit 1420. Since it is assumed that the field reverse signal FR is at L level, the table shown in FIGS. 7(*a*) and (*b*)

are referenced, and the binary signal Ds corresponding to the subfield Sf1 is output in accordance with the gray scale data D0 to D5.

Next, when the clock signal CLY falls and the scanning signal G1 is output, the uppermost scanning line 112 in FIG. 1 is selected, and as a result, all the transistors 116 of the pixels 110 associated with the intersections of the scanning line 112 are turned on.

Meanwhile, the latch pulse LP is output at the fall of the clock signal CLY. Then, at the timing of the fall of the latch pulse LP, the second latch circuit 1430 simultaneously supplies the binary signals Ds, having been latched dot by dot sequentially by the first latch circuit 1420, to each of the corresponding data lines 114 via the voltage selecting circuit 1440 as the data signals d1, d2, d3, . . . , dn. Thus, the data signals d1, d2, d3, . . . , dn are written simultaneously to the pixels 110 on the uppermost row.

Concurrently with the writing, binary signals Ds for the pixels of one row associated with the intersections of the second uppermost scanning line 112 in FIG. 1 are latched dot by dot sequentially by the first latch circuit 1420. Then, similar operations are repeated until the scanning signal Gm corresponding to the mth scanning line 112 is output. That is, during a horizontal scanning period (1H) in which a scanning signal Gi (i being an integer satisfying $1 \leqq i \leqq m$) is output, the writing of the data signals d1, d2, d3, . . . , dn for one row of pixels 110 associated with the ith scanning line 112 and the sequential dot-by-dot latching of binary signals Ds for one row of pixels 110 associated with the (i+1)th scanning line 112 are performed concurrently. The data signals written to the pixels 110 are held until the writing in the next subfield Sf2.

Thereafter, similar operations are repeated each time the start pulse DY defining the beginning of a subfield is supplied. As for the conversion of the gray scale data D0 to D5 into the binary signals Ds, the data conversion circuit 300 (see FIG. 1) references the corresponding subfield among the subfields Sf0 to Sf6. However, in the subfield Sf0, the level of the binary signal Ds is always at H level.

Furthermore, after one frame has passed, even when the frame reverse signal FR reverses to H level, similar operations are repeated for each of the subfields.

Next, the voltage to be applied to the liquid crystal layer of the pixels 110 by such operations will be considered. FIG. 9 is a timing chart showing the gray scale data and the waveform applied to a pixel electrode 118 at a pixel 110. For example, when the field reverse signal FR is at L level and the gray scale data DO to D5 of a pixel is "000000", as a result of the conversion shown in FIGS. 7(*a*) and (*b*), with regard to the pixel electrode 118 of the pixel, the voltage V1 is applied to the subfield Sf0 and zero voltage is applied to the other subfields, as shown in FIG. 9. When the voltage V1 is applied to the subfield S0, as described above, the maximum value of the voltage applied to the liquid crystal layer is V1 and the effective value thereof is Va. Thus, the transmissivity of the pixel is 0% in accordance with the gray scale data "000000".

When the field reverse signal FR is at L level and the gray scale data D0 to D5 of a pixel is "000010", as a result of the conversion shown in FIGS. 7(*a*) and (*b*), with regard to the pixel electrode 118 of the pixel, the voltage V1 is applied to the subfields Sf0 and Sf2, and zero voltage is applied to the other subfields Sf1 and Sf3 to Sf6, respectively, as shown in FIG. 9. Thus, as the gray scale data D0 to D5 becomes higher, the ratio of the time in a frame (1F) during which the voltage V1 is applied increases, the transmissivity of the pixel increasing in accordance therewith. When the field reverse signal FR is at L level and the gray scale data D0 to D5 of a pixel is "111111", as a result of the conversion shown in FIGS. 7(*a*) and (*b*), with regard to the pixel electrode 118 of the pixel, the voltage V1 is applied through the entirety of one frame (1F), as shown in FIG. 9. Thus, the transmissivity of the pixel is 100% in accordance with the gray scale data "111111".

Next, the operation when the field reverse signal FR is at H level will be described. In this case, H level is converted to the voltage—V1 and L level is converted to zero voltage via the voltage selecting circuit 140. Thus, with respect to zero voltage as a reference potential, which is the intermediate value of the voltage V1 and the voltage—V1, the voltage which is applied to the liquid crystal layer when the field reverse signal FR is at H level has a reverse polarity compared to the voltage applied when the field reverse signal FR is at L level, the absolute values thereof being equal. Thus, application of direct component to the liquid crystal layer is prevented, and as a result, degradation of the liquid crystal 105 is prevented.

In accordance with the electro-optical apparatus according to this embodiment, one frame (1F) is divided into subfields Sf1 to Sf6 in accordance with the voltage ratio of the gray scale characteristics, and H level or L level is written to the pixels for each of the subfields, thereby controlling the effective voltage value in the frame. Thus, the data signals d1, d2, d3, . . . , dn supplied to the data lines 114 have one of the three voltages, i.e., the voltage±V1 and zero voltage. Thus, in peripheral circuits such as a drive circuit, circuits that process analog signals, such as a high-resolution D/A conversion circuit and op amps, are not required. Therefore, the configuration of the circuitry is considerably simplified, allowing reduction of cost for the overall apparatus.

Furthermore, because the data signals d1, d2, d3, . . . , dn supplied to the data lines 114 have one of the three voltages, in principle, non-uniformity of display due to non-uniform component characteristics, wire resistances, etc., is prevented. Thus, the electro-optical apparatus according to this embodiment allows high-quality and high-resolution gray scale display.

In addition, in this embodiment, the subfield Sf0 in which the pixel is turned on regardless of the gray scale level is assigned within one frame, and the length of the subfield Sf0 can be adjusted by the voltage Va at which the transmissivity of the liquid crystal begins to rise. Thus, it may be applied to electro-optical apparatuses using various types of liquid crystal, allowing extended versatility of the apparatus.

Furthermore, in the embodiment, the number and timing of the start pulse DY generated within one frame can be switched on the basis of the gray scale level number selecting signal which is supplied to the hold circuit 240. Thus, when the electro-optical apparatus according to the embodiment is used as a display panel of a cellular phone or a personal computer, the number of gray scale levels can be reduced when the cellular phone is in wait mode or the personal computer is in a power-saving mode, further reducing power consumption.

3. Examples of Electronic Apparatuses 3.1 <Projector>

Next, several examples in which the electro-optical apparatus described above is applied to an actual electronic apparatus will be described.

First, a projector in which the electro-optical apparatus according to the embodiment is used as a light bulb will be described. FIG. 12 is a plan view showing the construction of the projector. As shown in FIG. 12, within the projector 1100, a polarizing illumination device 1110 is disposed along the light axis PL of the system. In the polarizing illumination device 1110, light emitted from a lamp 1112 is reflection by a reflector 1114 and becomes substantially parallel light beams which are incident on a first integrator lens 1120. Thus, the light emitted from the lamp 1112 is divided into a plurality of intermediate light beams. The divided intermediate light beams are converted into a single type of polarized light beam (s polarized light beam) with substantially one direction of polarization by a polarization conversion device 1130 having a second integrator lens on the light-incident side, and is emitted from the polarizing illumination device 1110.

The s polarized light beam emitted from the polarizing illumination device 1110 is reflected by an s polarized light beam reflection surface 1141 of a polarized light beam splitter 1140. Of the reflected light beam, light beam of the blue light (B) is reflected by a blue light reflecting layer of a dichroic mirror 1151 and modulated by an electro-optical apparatus 100B of the reflective type. Of the light beam which has transmitted the blue light reflecting layer of the dichroic mirror 1151, light beam of the red light (R) is reflected by a red light reflecting layer of a dichroic mirror 1152 and modulated by an electro-optical apparatus 100R of the reflective type. Meanwhile, of the light beam which has transmitted the blue light reflecting layer of the dichroic mirror 1151, light beam of the green light (G) transmits the red light reflecting layer of the dichroic mirror 1152 and modulated by an electro-optical apparatus 100G of the reflective type.

The red, green, and blue lights which have been color-modulated respectively by the electro-optical apparatuses 100R, 100G, and 100B are sequentially combined by the dichroic mirrors 1152 and 1151, and the polarized light beam splitter 1140, and projected onto a screen 1170 by an optical projection system 1160. Because light beams corresponding to each of the primary colors R, G, and B are incident on the electro-optical apparatuses 100R, 100B, and 100G by the dichroic mirrors 1151 and 1152, color filters are not required.

The projector 1100 projects an image onto the screen 1170 based on an image signal which is externally supplied, and displays, for example, "VSYNC OFF" when the image signal is interrupted. For such a display, a large number of gray scale levels is not required; thus, for example, a gray scale level number selecting signal specifying the number of gray scale levels "2" is supplied to the hold circuit 240 from a control circuit (not shown) for display.

3.2 <Mobile Computer>

Next, an example in which the electro-optical apparatus is applied to a mobile personal computer will be described. FIG. 13 is a perspective view showing the front of the personal computer. Referring to FIG. 13, the mobile computer 1200 includes a main unit 1204 provided with a keyboard 1202, and a display unit 1206. The display unit 1206 is constructed by adding a front light in front of the electro-optical apparatus 100 already described. Because the electro-optical apparatus 100 will be used as the reflective direct-view type in accordance with the construction, the arrangement is preferably such that concavities and convexities are formed so that reflected light will be dispersed in various directions at the pixel electrodes 118.

The mobile computer enters a power-saving mode when the user does not operate the keyboard 1202, etc. for a predetermined period. In this case, the display unit 1206 performs a power-saving display, for example, "POWER SAVE". Because a large number of gray scale levels is not required for such a display, under the control of a device driver (software) which runs on the mobile computer, for example, a gray scale level number selecting signal specifying the number of gray scale levels "2" is supplied to the hold circuit 240.

Furthermore, in a typical mobile computer, the user is enabled to selectively perform various power-saving measures in order to preserve the time of battery operation; for example, whether or not the front light of the electro-optical apparatus 100 be darkened (or turned off), whether or not rotation of the hard disk be stopped except when it is accessed, whether or not the CPU clock be reduced, etc. When the electro-optical apparatus 100 in the embodiment is used in the mobile computer, it is preferable that the selection of "the number of gray scale levels during battery operation" is enabled in addition. More specifically, the display is preferably such that the number of gray scale levels is "64" when the mobile computer is driven by a commercial power supply, and the number of gray scale levels is one of "64", "16", and "2" as specified by the user when it is driven by the battery.

3.3 <Cellular Phone>

Furthermore, an example in which the electro-optical apparatus is applied to a cellular phone will be described. FIG. 14 is a perspective view showing the construction of the cellular phone. Referring to FIG. 14, the cellular phone 1300 includes a plurality of operation buttons 1302, an earpiece 1304, a mouthpiece 1306, and the electro-optical apparatus 100. A front light is provided as required at the front of the electro-optical apparatus. Because the electro-optical apparatus 100 is used as the reflective direct-view type in accordance with the construction, the arrangement is preferably such that concavities and convexities are formed on the pixel electrodes 118.

When the cellular phone is in a wait mode or simply performing voice communication, a large number of gray scale levels is not required for the electro-optical apparatus 100; thus, a gray scale level number selecting signal specifying the number of gray scale levels "2" is usually supplied to the hold circuit 240. On the other hand, when the cellular phone is used as a television phone and the face of the user is displayed on the electro-optical apparatus 100, or when an Internet homepage is displayed on the electro-optical apparatus 100, the number of gray scale levels for the electro-optical apparatus 100 is set to "16" or "64".

3.4 <Others>

Electronic apparatuses other than described above include a liquid crystal television, a video tape recorder of the view-finder type or the monitor direct viewing type, a car navigation apparatus, a pager, an electronic notebook, an electronic calculator, a word processor, a workstation, a television phone, a POS terminal, equipment provided with a touch panel, etc. It is to be understood that the electro-optical apparatus described above can be applied to these various electronic apparatuses. These various electronic apparatuses require a display with a large number of gray scale levels in some cases and do not require it in other cases depending on the situation, the number of gray scale levels being controlled similarly to the cellular phone, etc. described above.

4. Modifications

The present invention is not limited to the above-described embodiment, and various modifications, for example, the ones listed below, are possible.

(1) Although the polarity of the field reverse signal FR reverses at a cycle of one frame in the above-described embodiment, the present invention is not limited thereto, and the arrangement may be such, for example, that the polarity reverses at a cycle of two or more frames. However, because the arrangement is such in the above-described embodiment that the data conversion circuit 300 counts the start pulse DY and resets the result of the counting in accordance with the transition of the field reverse signal FR in order to recognize the current subfield, a signal defining the frames must be given in the case where the polarity of the field reverse signal FR reverses at a cycle of two or more frames.

(2) Although the drive signal LCOM which is applied to the opposing electrodes 108 is at zero voltage in the above-described embodiment, the voltage applied to each of the pixels may be shifted due to the characteristics of the transistors 1 16, the storage capacitors 119, and the capacitance of the liquid crystal, etc. In such a case, the level of the drive signal LCOM, which is applied to the opposing electrodes 108, may be shifted in accordance with the amount of the voltage shift.

(3) Furthermore, although the device substrate 101 constituting the electro-optical apparatus is a semiconductor substrate and the transistors 116 connected to the pixel electrodes 1 18 and components of the drive circuits are formed of MOSFETs in the above-described embodiment, the present invention is not limited thereto. For example, the arrangement may be such that the device substrate is an amorphous substrate formed of glass or quartz, a thin semiconductive film being deposited thereover to form TFTs. When the TFTs are used, a transparent substrate may be used as the device substrate 101. Furthermore, the scanning line drive circuit 130 and the data line drive circuit 140 may be provided externally.

In addition, other arrangements are possible in which, for example, the timing signal generating circuit 200, the data conversion circuit 300, and the data line drive circuit 140 are integrated on a single chip, or other circuits are integrated.

(4) Furthermore, although the above-described embodiment deals with a case where the present invention is applied to an electro-optical apparatus using liquid crystal, it may be applied to other electro-optical apparatuses, in particular, any electro-optical apparatus which allows a gray scale display using pixels which performs an ON/OFF binary display. Such electro-optical apparatuses may include electro-luminescence apparatuses and plasma display apparatuses. Particularly in the case of organic EL, alternating drive as in the case of liquid crystal is not required, not requiring the polarity to be reversed.

(5) In the above-described embodiment, for example, if the number of gray scale levels is "64", subfields Sf1 to Sf6, equal to the number of the digits (6) of the binary representation of the gray scale levels, are provided in addition to the subfield Sf0, the ON/OFF state of the subfields Sf1 to Sf6 being determined according to the value of each of the bits. However, the arrangement may be such that a number of subfields equal to the number of "the number of gray scale levels−1" is provided, the ON/OFF state of the subfields being determined according to the gray scale levels.

FIG. 10 shows the relationship between the gray scale data and a waveform applied to the pixel electrodes 118 in the case. Referring to FIG. 10, the start pulse DY rises 64 times within a frame, the periods between each rise timing and the next rise timing (the period until the next frame as for the last subfield Sf63) being the subfields Sf0 to Sf63, respectively. When the field reverse signal FR is at L level and the gray scale data D0 to D5 for a pixel is "000000", as shown in FIG. 10, a voltage V1 is applied to the subfield Sf0, and zero voltage is applied to the other subfields.

If the gray scale data D0 to D5 of a pixel is "000011" or "3", the voltage V1 is applied to the first to the third subfields of the subfields Sf1 to Sf63, and zero voltage is applied to the other subfields Sf4 to Sf63, respectively. As the gray scale data D0 to D5 becomes higher, the time during which the voltage Vi is applied increases within a frame (1F), the transmissivity of the corresponding pixels increasing in accordance therewith. If the gray scale data D0 to D5 of a pixel is "111111", the voltage V1 is applied over the entirety of a frame (1F).

In this modification, the periods between each of the subfields Sf1 to Sf63 are not the same, and are increased or decreased in accordance with the transmissivity characteristics in relation to the effective voltage value of the liquid crystal 105. That is, the periods between each of the subfields are set so that a linear transmissivity can be obtained by turning the subfields Sf1 to Sf63 on and off according to the gray scale data D0 to D5. Thus, for example, appropriate gray scale characteristics can be provided without externally providing, for example, a gray scale correction table. In such a method, 64 gray scale levels involve 64 subfields, 16 gray scale levels involve 16 subfields, and 2 gray scale levels involve 1 subfield, the effect of reducing power consumption becoming even larger when the number of gray scale levels is decreased.

(6) In the above-described embodiment, the arrangement may be such that an adjuster pin which allows the user to adjust the data DS0 defining the length of the subfield Sf0 is provided, so that the value of data DS0 can be changed by the user operating it. In addition, the arrangement may be such that the temperature of the liquid crystal display apparatus or the temperature of the periphery of the liquid crystal display apparatus is detected by a temperature sensor, so that the value of the data DS0 can be changed based on the detected temperature and in accordance with the temperature characteristics of the liquid crystal. Furthermore, depending on the characteristics of the liquid crystal, another subfield Sf7 (not shown) for which the pixel is always turned off regardless of the gray scale level may be added, supplying corresponding data DS7 to the multiplexer 213.

Because the sum of the data DS0 and the data DS7 is constant, when the value of the data DS0 is increased or decreased, the value of the data DS7 should be changed accordingly. Thus, without changing the data DS 1, DS2, . . . , DS6, the length of the subfield Sf0 can be changed only by changing the data DS0 and DS7. When the subfield Sf0 is made variable in accordance with the temperature characteristics of the liquid crystal, the effective value of the voltage, which is applied to the liquid crystal, can be made variable in accordance with the change in the ambient temperature; thus, even if the temperature changes, the gray scale level and the contrast ratio of display can be maintained constant.

(7) The start pulse generating circuit 210 may be implemented in various constructions other than those shown in FIG. 5. For example, the arrangement may be such that the value of the upper count-up limit of the ring counter 214 is switched according to the gray scale level number selecting signal, the values of the data DS0, DS1, . . . , DS6 input to the multiplexer 213 being switched according to the gray scale level number selecting signal. In this case, when 64 gray scale levels are selected, the ring counter 214 is set so as to count from "0" to "6", data corresponding to the subfields for the 64 gray scale levels being given to the data DS0, DS 1, . . . , DS6. In the case of 16 gray scale levels, the ring counter 214 is set so as to count from "0" to "4", data corresponding to the subfields for the 16 gray scale levels being given to the data DS0, DS1, . . . , DS4. In such an arrangement, a single start pulse generating circuit 210 can be made compatible with different numbers of gray scale levels.

(8) Although the scanning lines 112 are selected sequentially from the top by exclusively outputting scanning signals G1, G2, G3, . . . , Gm sequentially in the above-described embodiment, the order of selecting the scanning lines 112 is not limited thereto. For example, the scanning signals may be output for every plurality of lines, such as "G1, G11, G21, . . . , G2, G12, G22, . . . , G3, G13, G23, . . . ", selecting all the scanning lines 112 within a subfield.

What is claimed is:

1. A method of driving an electro-optical apparatus in which a plurality of pixels arranged in a matrix perform a gray scale display, the method of driving an electro-optical apparatus comprising:

selectively setting a number of subfields within a frame in accordance with a signal specifying a number of gray scale levels;

dividing said frame into the specified number of subfields; and controlling on or off of each of the pixels in each of said subfields in accordance with the gray scale level of the pixels; and the pixel is turned on regardless of the gray scale level in an initial subfield within one frame, a length of the initial subfield is determined in accordance with a threshold voltage, the threshold voltage is an effective voltage at which the gray scale level begins to change at the pixel.

2. The method of driving an electro-optical apparatus according to claim 1, further including:

providing said pixels in association with each of the intersections of a plurality of scanning lines and a plurality of data lines, so that when a scanning signal is applied to the associated scanning line, the pixels are turned on and off according to the voltages applied to the associated data line; and supplying, for each of said subfields, said scanning signal sequentially to each of said scanning lines and supplying a signal which specifies on or off in accordance with the gray scale level for each of the pixels to each of the data lines corresponding to each of the pixels.

3. A drive circuit for an electro-optical apparatus which drives pixels that includes pixel electrodes disposed in association with each of intersections of a plurality of scanning lines and a plurality of data lines, and switching elements provided in association with each of the pixel electrodes and which electrically connect an associated data line and an associated pixel electrode when a scanning signal is supplied to the associated scanning line, the drive circuit for an electro-optical apparatus comprising:

a scanning line drive circuit that supplies said scanning signal sequentially to each of said scanning lines for each of the subfields constituting a frame;

a data line drive circuit that supplies a signal which specifies on or off of each of said pixels for each of said subfields in accordance with the gray scale levels of each of said pixels to the data lines associated with the pixels during the period when said scanning signal is supplied to the scanning lines respectively corresponding to the pixels; and a subfield number setting circuit that selectively sets the number of subfields within said frame in accordance with said signal which specifies the number of gray scale levels, the pixel is turned on regardless of the gray scale level in an initial subfield within one frame, a length of the initial subfield is determined in accordance with a threshold voltage, the threshold voltage is an effective voltage at which the gray scale level begins to change at the pixel.

4. An electro-optical apparatus, comprising:

a plurality of scanning lines that provide scanning signals;

a plurality of data lines;

a device substrate provided with pixel electrodes disposed in association with each of intersections of the plurality of scanning lines and the plurality of data lines, and switching elements provided in association with each of said pixel electrodes, which controls the electrical connection between the associated data line and the associated pixel electrode based on a scanning signal which is supplied via the associated scanning line;

an opposing substrate provided with an opposing electrode disposed opposing said pixel electrodes;

an electro-optical material interposed between said device substrate and said opposing substrate;

a scanning line drive circuit that supplies said scanning signal sequentially to each of said scanning lines for each of subfields constituting a frame;

a data line drive circuit that supplies a signal which specifies on or off of each of said pixels for each of said subfields in accordance with the gray scale levels of each of said pixels to the data lines associated with the pixels during a period in which said scanning signal is supplied to the scanning lines respectively corresponding to the pixels; and a subfield number setting circuit that sets a number of subfields within said frame in accordance with a gray scale level number specifying signal which specifies a number of said gray scale levels, the pixel is turned on regardless of the gray scale level in an initial subfield within one frame, a length of the initial subfield is determined in accordance with a threshold voltage, the threshold voltage is an effective voltage at which the gray scale level begins to change at the pixel.

5. An electronic apparatus, comprising:

the electro-optical apparatus according to claim 4; and a control circuit which supplies said gray scale level number specifying signal to said subfield number setting circuit.

* * * * *